United States Patent [19]

Blank

[11] 4,293,894

[45] Oct. 6, 1981

[54] BATTERY OPERATED ILLUMINATING DEVICE

[76] Inventor: Nolan D. Blank, 2294 Stow Ave., Simi Valley, Calif. 93063

[21] Appl. No.: 130,604

[22] Filed: Mar. 17, 1980

[51] Int. Cl.[3] ..... E05B 17/10

[52] U.S. Cl. ..... 362/100; 362/186; 362/191

[58] Field of Search ..... 362/100, 186, 191

[56] References Cited

U.S. PATENT DOCUMENTS 500,026 6/1893 Morey ..... 362/100

595,444 12/1897 Roll et al. ..... 362/100

*Primary Examiner*—Stephen J. Lechert, Jr.

*Attorney, Agent, or Firm*—John G. Mesaros

[57] ABSTRACT

A battery operated illuminating device having a frustoconical housing configured for mounting to a surface adjacent the object to be illuminated, the housing having an integrally formed depressable portion for operating a switch within the housing. A lens in the side of the housing is configured for illumination of the desired objects. An electronic subassembly within the housing is operable by the switch upon a single depression with an electronic time delay provided for de-energizing a light bulb.

10 Claims, 5 Drawing Figures

BATTERY OPERATED ILLUMINATING DEVICE

BACKGROUND OF THE INVENTION

The background of the invention will be discussed in two parts:

FIELD OF THE INVENTION

This invention relates to battery operated illuminating devices and more particularly to an illuminating device for illuminating the doorknob and keyhold.

DESCRIPTION OF THE PRIOR ART

Many requirements exist for illumination with some such requirements lending themselves readily to battery operated illuminating devices. One requirement in which battery operated devices is particularly suitable is the requirement existing in homes for illuminating the entryway. If an individual is away from his residence and expects to return after dark, the porch lamp may sometimes be used as a means for illuminating the entryway to facilitate visual access to the doorknob and keyhole. However, the use of a porch lamp for such a purpose may be energy wasting and may also provide visual evidence to a potential intruder that the premises are not occupied. This latter problem is particularly acute when the occupants expect to return very late in the evening.

Keyhole illumination has been a problem which has received considerable attention in patented devices. Such patented devices can be classified broadly in several groups. One such group includes devices where the doorknob, escutcheon plate, or lock assembly have been modified to incorporate a light source or switch. In this grouping such devices are illustrated in U.S. Pat. Nos. 1,136,378; 1,191,783; 1,230,942; 1,284,570; 1,349,360; 1,358,926; 1,674,159; 1,738,243; 1,810,775; 1,841,570; 1,985,483; 1,929,741; 2,005,274; 2,029,002; 2,226,854; 2,242,626; 2,438,847; 2,709,745; and 4,078,248. With such devices, if one wishes to provide illumination, either the door assembly or the lock assembly must be replaced in its entirety with an existing installation. Furthermore, such devices tend to be elaborate in construction with an attendant cost of manufacture consistent with that construction.

Another group of such devices are of the type configured for mounting on the doorjamb for illuminating the lock and/or keyhole of the door. Such devices are shown for example in U.S. Pat. Nos. 1,961,865; 2,176,662; 2,254,842; 2,480,223; 2,562,687; 2,790,068; 2,813,195; 2,914,656; 3,711,694; and 3,787,677. Some of these devices are configured for recessed mounting within the doorjamb which thus complicates the mounting of the device for use. Some of the devices of this group are surface mounted, that is the housing is mounted on the surface of the jamb which facilitates the mounting of the device. If the surface mounting is adjacent the doorknob, there is a problem with the potential breakage of the unit or interference with opening of the door because of the proximity to the doorknob. In the last mentioned of the above patents as well as some of the others, the device is configured and constructed so that the switch member urges against an outer door such as a screen door or storm door with the opening of the outer door serving to actuate the switch. With such units, if the light source is operated from a battery and located remotely from the object desired to be illuminated, that is, the keyhole, the intensity of the light available at the keyhole may be below a desired level.

Other patented devices include U.S. Pat. No. 1,342,777 which is simply a luminous indicator utilizing the luminescence of a material as an indicator. Another such device is U.S. Pat. No. 2,296,009 in which the door light switch is configured in the form of a handle to facilitate actuation or energization of the light source. U.S. Pat. No. 2,831,959 provides an exposed spaced conductive arrangement as the switch with the key being utilized to bridge the gap between adjacent conductors as a means for energizing the battery circuit. However, in this device the lamp is illuminated so long as the key is touching the switch means.

A more elaborate switch assembly is shown and described in U.S. Pat. No. 4,037,221 utilizing electronic circuitry operable by a person contacting the doorknob or inserting a key in the lock. The switch assembly of this patent includes timing means for activating the electrical load for a predetermined time. However, the system of this invention requires a touch plate and provides system illumination, that is illumination of the entryway. Furthermore, the touch plate concept requires a continuous incoming signal for actuation of the system.

U.S. Pat. No. 2,136,677 discloses a modified assembly utilizing the key to actuate a safety device for an alarm system in which illumination of the keyhole is part of the device.

Another group of such patented devices are functionally flashlights with modified housing or switches for surface or recessed mounting on the door itself in proximity to the keyhole or doorknob to be illuminated. Such devices are shown and described in U.S. Pat. Nos. 1,647,001; 2,304,690; 2,510,819; 2,529,234; 2,536,593; 2,661,417; 2,699,490; 2,732,480; 2,765,396; 2,842,657; 2,927,197; and 3,590,234. Of these devices the majority require that the switch be continually activated or alternatively activated and deactivated manually for maintaining the illumination. Furthermore, most of these devices of this group are provided with small switches which may not be easily found in the darkness. Furthermore, such small switches require that one hand be free for their operation. Of these patented devices, only two are especially relevant to the present invention.

U.S. Pat. No. 2,304,690 discloses a keyhole illuminator in which the outer covering when tilted or pivoted serves a twofold purpose, one being to actuate the switch and the other being to uncover the lamp. However, such a device requires a constant depression so long as illumination is desired.

Of this last group of patents, U.S. Pat. No. 3,590,234 discloses an illuminating device having a time delay where the time delay is a vacuum cup. The circuit is energized during the time period that it takes for the vacuum cup to return to its original position after depression. However, the vacuum cup is actuated by a pushbuttom of relatively small diameter and a force must be exerted on that pushbutton sufficient for the vacuum to take effect for proper operation of the device.

It is an object of the present invention to provide a new and improved illuminating device particularly suited for illuminating the keyhole and doorknob of an entryway.

It is another object of the present invention to provide a new and improved illuminating device having electronic time delay means for energizing the lamp for a predetermined time after actuation.

It is a further object of the present invention to provide a new and improved illuminating device having an integrally formed plate portion easily depressable for actuating the electronic means.

SUMMARY OF THE INVENTION

The foregoing and other objects of the invention are accomplished by providing an illuminating device having a base plate configured for surface mounting in proximity to the object desired to be illuminated. The base plate has affixed thereto electronic circuitry including semiconductor switches and a time delay circuit operable by means of a battery for energizing a lamp mounted thereon. A frusto-conical housing is provided with an integrally formed pressure plate area operable on deforming thereof to actuate a switch for energizing the circuitry. The housing is generally cup-shaped with the open end being received about the base plate and the side surface of the housing being provided with a lens positionable adjacent the lamp for illuminating the desired objects such as a keyhole and doorknob.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
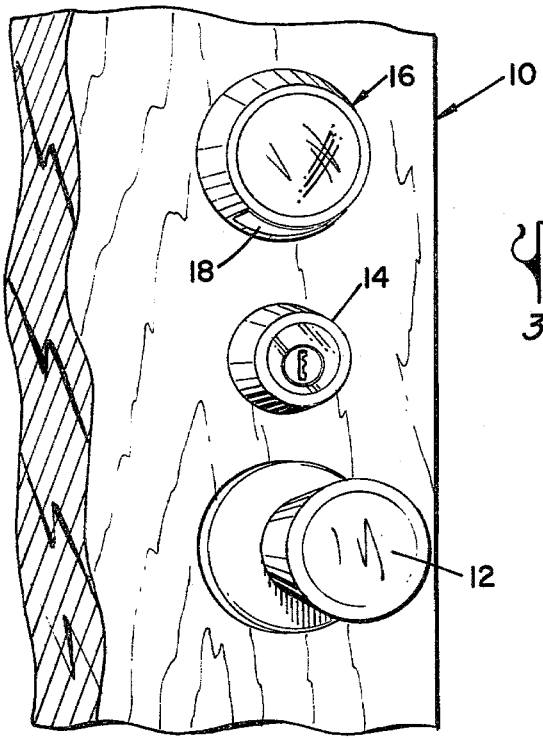
FIG. 1 is a perspective view of a portion of a door showing the illuminating device mounted above the keyhole and doorknob thereof.

Referring now to FIG. 1 there is shown an entry door 10 of conventional configuration having a doorknob 12 mounted thereon with a lock assembly 14 immediately thereabove. Positioned above the lock assembly 14 is an illuminating device 16 according to the invention, the device 16 being surface mounted to the door 10 in a position for illuminating both the doorknob 12 and lock assembly 14 to facilitate entry in subdued light. In some instances, the lock assembly 14 may be positioned below the doorknob 12 and in those instances, the illuminating device 16 may be positioned therebelow with the lens portion 18 of the illuminating device 16 pointed upwardly to illuminate the doorknob 12 and lock assembly 14.

Figure 2:
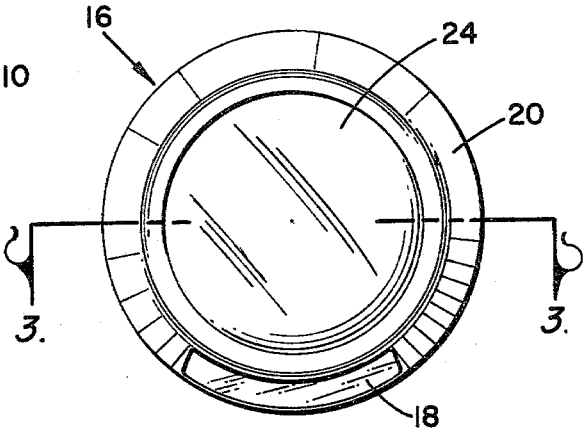
FIG. 2 is a front view of the illuminating device shown in FIG. 1.
Figure 3:
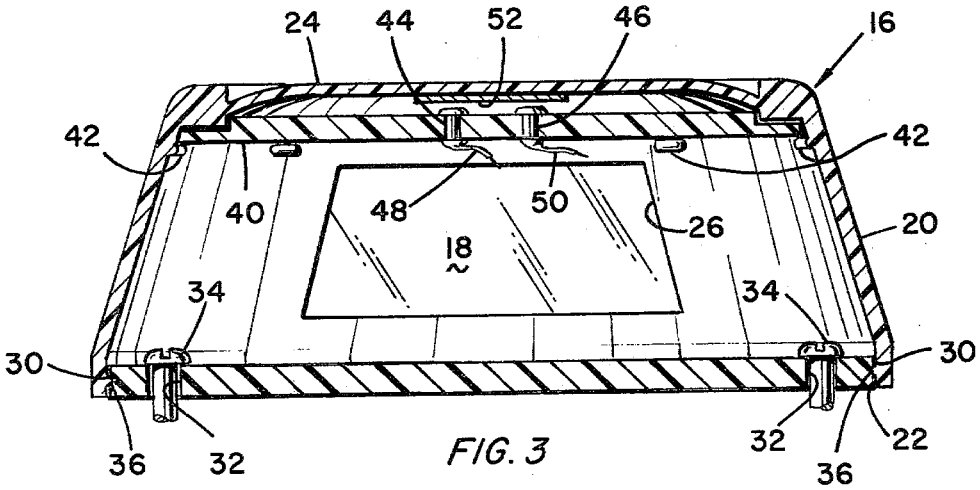
FIG. 3 is a sectional view of the housing utilized in the illuminating device of FIG. 1.

Referring also to FIGS. 2 and 3, the illuminating device 16 includes a frusto-conico housing 20 which has an open bottom 22 and an integrally formed pressure plate portion 24 of a reduced fitness to permit deformation upon the application of pressure to energize the electronics in a manner to be hereinafter discussed. As best illustrated in FIG. 3, the pressure plate portion 24 is of an inverted dish-shaped configuration circular in plan view and having a relatively large diameter contrasted to the overall diameter of the housing 20. With this configuration, a relatively broad area is provided as the switch means which can be readily found in subdued light or in the dark. Furthermore, even with both hands occupied by the occupant of the premises, the pressure plate portion 24 can be easily deformed to activate the electronics by use of an elbow, a clenched fist (which may be holding other things) or the like. While the pressure plate portion 24 may be formed as a separate piece, economies of manufacture are obtained by molding it integrally with the housing 20 which may be formed of a suitable plastic or the like. With this unitary construction of the housing 20 and pressure plate portion 24 a weatherproof covering for the electronics therein is readily obtained.

The sidewall of the housing 20 is provided with a trapezoidal opening 26 which receives therein a suitable lens 18 which is generally transparent with the balance of the housing 20 being translucent or opaque. The lens 18 may be provided with a prismatic or diffuser surface to facilitate dispersion of the light in the direction desired for proper illumination of the doorknob 12 and lock assembly 14 in proximity thereto.

As best illustrated in FIG. 3 the illuminating device 16 assembly is further provided with a baseplate 28, circular in plan view with a groove 30 about the periphery thereof. The baseplate 28 is also provided with a pair of apertures 32 which may be diametrically opposite for passage therethrough of suitable fastening means such as screws 34 for mounting to the surface of the door 10. The inner surface of the housing 20 adjacent the opening 22 is provided with inwardly extending detent means 36 for matingly engaging the groove 30 for retaining the housing 20 on the baseplate 28 while permitting ready removal for changing the battery therein as will hereinafter be described.

Another portion of the assembly for the illuminating device 16 is the switch plate 40 which is a smaller diameter circular disc-shaped insulating member configured for a "snap fit" within the housing 20 in proximity to and parallel relation with the main surface of the pressure plate portion 24. As can be seen in FIG. 3, the switch plate 40 has a peripheral flange, the outer diameter of which is generally equal to the inner diameter of the housing 20 beneath the pressure plate portion 24. The inner wall of the housing 20 is provided with inwardly extending tangs 42 (or a peripheral rib) with the dimension between the outer ends of the tangs 42 being slightly smaller than the outer diameter of the flange of switch plate 40. Thus, the switch plate 40 is inserted through the open end of the housing 20 and urged over the tangs 42 until it is locked in place.

At the approximate midpoint of the switch plate 40 a pair of conductive eyelets 44 and 46 extend therethrough in spaced proximate relation. Suitable conductive leads 48 and 50 are secured such as by soldering to the ends of the eyelets 44 and 46 within the housing 20, these leads 48 and 50 ultimately being connected to the electronics to be hereinafter described. To effect the switching action, the undersurface of the pressure plate portion 24 above the eyelets 44 and 46 is provided with a conductive layer or foil 52. With the pressure plate portion 24 in its normal position, the foil 52 is in spaced proximate relation to the upper enlarged heads of the eyelets 44 and 46. When the pressure plate 24 is urged inwardly, the foil 52 bridges the eyelets 44 and 46 to thereby provide a conductive path which need be only momentary.

Figure 4:
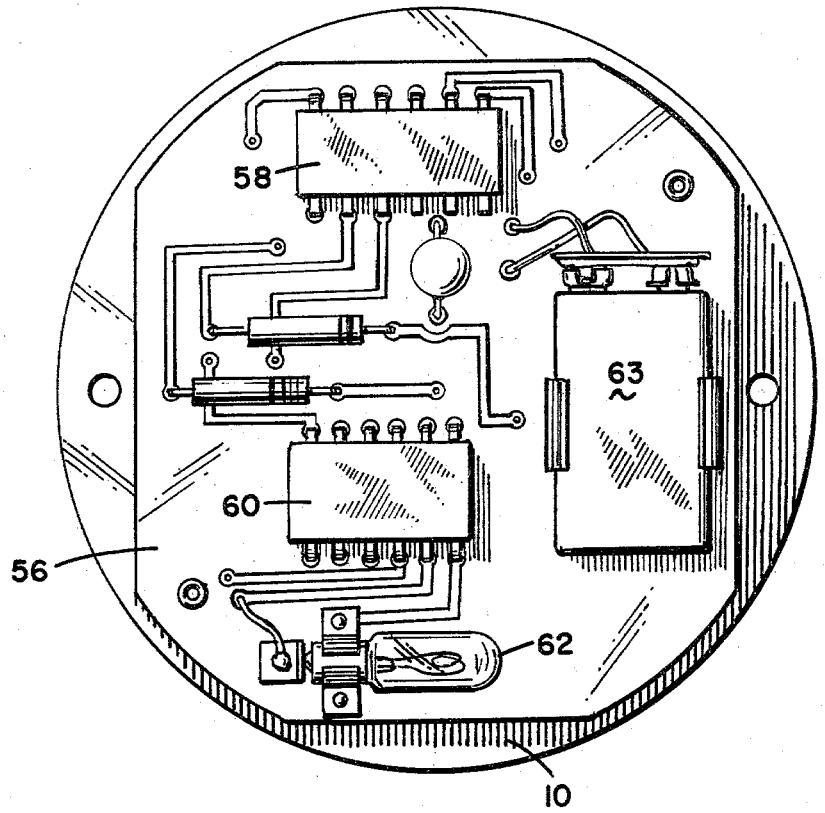
FIG. 4 is a plan view of the backplate of the illuminating device of FIG. 1 depicting electronics and a lamp mounted thereon.

FIG. 4 illustrates diagramatically the base plate 10 having mounted thereon a printed circuit board 56 with suitable electronic components such as integrated circuits 58 and 60 assembled thereon. The electronic components are illustrated for descriptive purposes and need not conform to the actual electronics employed in the circuit to be hereinafter described. The printed circuit board 56 also has assembled thereon a suitable illuminating source such as lamp 62 with a voltage source such as a battery 63 for providing the source of energy to the electronic components.

Figure 5:
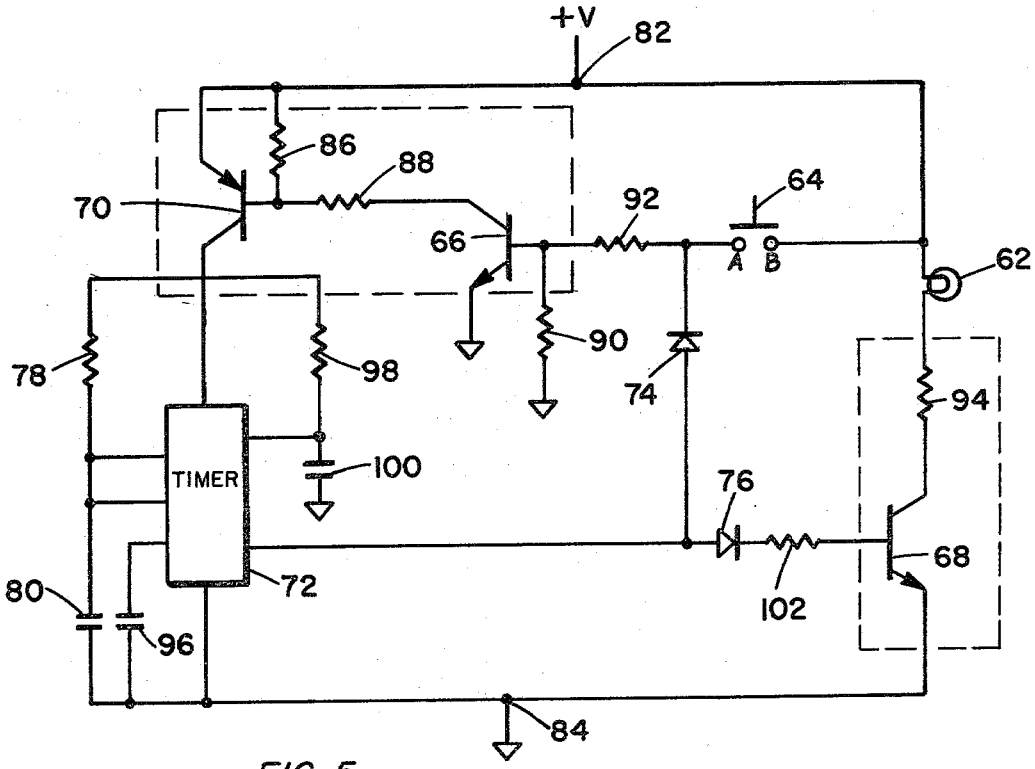
FIG. 5 is a schematic diagram of the electronic circuitry used in the illuminating device of FIG. 1.

The actual electronics are depicted schematically in FIG. 5 with the lamp 62 being depicted schematically and the switch bearing reference numeral 64 being the switch formed by the foil 52 on the undersurface of pressure plate portion 24 coacting with the eyelets 44 and 46. The main functional components of the circuit are two NPN transistors 66 and 68, one PNP transistor 70, an integrated circuit timer 72, two diodes 74 and 76, and an RC time delay network including resistor 78 and capacitor 80.

The positive terminal of the battery 63 bears reference numeral 82 with the negative or ground terminal of the battery 63 bearing reference numeral 84 in the schematic of FIG. 5.

Schematically the circuit is configured as follows. The positive source of voltage 82 is connected to the emitter of transistor 70 with a biasing resistor 86 connected between the base and emitter thereof. The base of transistor 70 is connected to the collector of transistor 66 by means of a second transistor 88, the emitter of transistor 66 being connected to ground. Transistor 66 is connected in common emitter fashion by means of a resistor 90 connected between the base and ground. Another resistor 92 interconnects the base of transistor 66 with one terminal "A" of switch 64. The other terminal "B" of switch 64 is connected to the positive voltage source 82.

The transistor 68 acts as a power switch connected in series with lamp 62, The connection being from the positive source of voltage 82 through the lamp 62 through a load resistor 94 from the collector through the emitter of transistor 68 to ground.

The timer 72 may be for example a time delay integrated circuit such as manufactured by National Semiconductor Corporation under the designation LM555. The terminal designations about the rectangular block 72 correspond to the terminals of the National Semiconductor timer integrated circuit. The output of the timer 72 appears on terminal "3". The ground connection is terminal "1" while the control voltage is applied to terminal "5". Terminals "6" and "7" are the "threshold" and "discharge" inputs respectively while terminal "8" is designated for receiving the positive source of voltage. Terminal "2" is the "trigger" input for the timer 72.

The positive source of voltage is applied when transistor 70 is conductive by means of the connection of the collectors of transistor 70 to the positive voltage terminal "8" of timer 72. Resistor 78 interconnects the collector of transistor 70 with the threshold and discharge terminals "6" and "7" of timer 72, these two terminals being connected together. The capacitor 80 is connected between these interconnected terminals and ground 84 and a second capacitor 96 interconnects the control voltage terminal "5" and ground 84. A resistor 98 interconnects the collector of transistor 70 and the trigger terminal "2" of timer 72 to which is also connected one end of a capacitor 100, the other end being connected to ground 84.

The output terminal "3" of timer 72 is provided to the anodes of the diodes 74 and 76, the cathode of diode 74 being connected to the terminal "A" of switch 64. The cathode of diode 76 is connected in series through resistor 102 to the base of transistor 68.

Briefly, the operation of the circuit is as follows. Upon momentary depression of switch 64 transistors 66 and 70 are rendered conductive to accomplish two things, one of which is to apply the biasing voltage to the timer 72 and the other of which is to charge the capacitor 80 through resistor 78 to a voltage approximately that of the source voltage 82. Upon charging of the capacitor 80 and during the discharge thereof an output is provided at terminal "3" of timer 72 for a timed duration determined by the values of resistor 78 and capacitor 80. This output is a positive signal applied to the anodes of diodes 76 and 74 which then conduct. Diodes 74 and 76 act as holding means for holding the transistors 66, 68 and 70 conductive for the predetermined time delay. Transistors 66 and 70 act as switches in the primary circuit to the timer 72 and the RC network time delay consisting of the resistor 78 and capacitor 80. Diode 76 maintains its conductivity to maintain the conduction of transistor 68 and thus the energization of lamp 62 in series therewith for this predetermined time period notwithstanding the momentary actuation of switch 64.

In detail, the operation is initiated with momentary actuation of the switch 64 which applies the positive source of voltage 82 to one end of the biasing resistor 92 in series with the collector of transistor 66 thus rendering it conductive. Upon conduction of transistor 66, transistor 70 conducts thus applying the positive voltage source 82 to the terminal "8" of the timer 72. Simultaneously with the conduction of transistor 70, a circuit is completed from the positive source of voltage 82 through the RC network (resistor 78 and capacitor 80) to ground 84 thus charging capacitor 80. Transistors 66 and 70 act as a first switching means for charging the capacitor 80 as well as applying the necessary bias voltage to the timer 72. During this transistion state when this first switching means is turned on, a triggering pulse is applied to terminal "2" and a threshold pulse is applied to terminal "6" of the timer 72. Once the capacitors 80 and 100 are fully charged the transistor 70 only applies the positive voltage as a biasing voltage to the timer 72. The capacitor 80 then commences discharge through resistors 78 and 98 through capacitor 100 to ground. During this discharge time, the output appearing at terminal "3" of timer 72 continues notwithstanding the momentary actuation of switch 64, this output voltage appearing at the anodes of the diodes 74 and 76 which act as means for holding transistors 66, 68 and 70 in conduction for the time duration of the time delay. The output voltage appears in the base circuit of the transistor 66 of the first switch means by virtue of the diode 74 being rendered conductive. Simultaneously, this same output voltage appears in the base circuit of transistor 68 of the power switch means for maintaining the lamp in an energized state by conduction from the positive voltage source 82 through the lamp 62 through resistor 94 through transistor 68 to ground 84. When transistor 80 discharges the output appearing on terminal "3" of timer 72 goes low, that is to ground, at which point diodes 74 and 76 are no longer conductive thereby disabling the switch means. That is, transistors 66 and 68 go low. At this point there is no current drain on the battery since there are no longer any conductive paths between the positive source of voltage 82 and the ground 84. With all power removed from the circuit, battery life is thus preserved with current drain on the battery being limited to those times during which transistors 66, 68 and 70 are conductive along with of course energization of the lamp 62.

Representative values for the components of the circuit depicted in FIG. 5 are as follows: The positive source of voltage 82 is 9 volts; resistor 86 is 22,000 ohms; resistor 88 is 2,000 ohms; resistor 90 is 33,000 ohms; resistor 92 is 10,000 ohms; resistor 94 is 9 ohms; resistor 102 is 2,000 ohms; resistor 78 is 2.7 megohms; resistor 98 is 1 megohm; capacitor 80 is 5.6 microfarads; capacitor 96 is 0.01 microfards; and capacitor 100 is 0.0 microfarads. Transistors 66 and 68 may be for example transistors designated 2N2222A with transistor 70 being a transistor designated 2N2907, these being common transistor designations. Diodes 74 and 76 must have sufficient current carrying capacity and may be for example diodes designated 1N3600. With these particular components, the lamp 62 will be energized for approximately 15 seconds after momentary actuation of switch 64.

Referring again to FIGS. 1 through 3, the illuminating device 16 may have the housing 20 thereof configured in a manner conforming aesthetically with the lock assembly 14 and the doorknob 12 with the coloring being selected to fit. Decorative backplates or escutcheons may be used around the housing 20 for appearance if desired. The housing 20 may be conveniently formed of a molded plastic and need not be circular in appearance. However, the pressure plate portion 24 should be of a relatively large size compared to the overall dimensions to facilitate access to and depression of the switch means. The spacing between the undersurface of the deformable touch plate or pressure plate portion 24 and the spaced switch eyelets 44 and 46 should be very close to permit ready operation of the electronics upon the slightest depression of the plate portion 24.

The overall size of the lens 18 is selected so that the illumination from the light source 62 provides a proper arc of illumination to the working parts or objects to be illuminated. Furthermore, the depth of the housing 20 and the positioning of the lens 18 as well as the lamp 62 are so selected to project light outwardly from the surface of the door 10. In the embodiment illustrated, overall the dimesion of the base of the housing 20 may be aproximately two and three quarter inches with the dimension or diameter of the pressure plate 24 being approximately two inches or slightly less. The depth of the housing 20 may be approximately one inch with the lens 18 being approximately one and one-half inches by approximately one-half inch. The electronic components, lamp 62 and battery 63 are readily mountable on the base plate thus providing a compact unit.

It is to be understood that while the description of the preferred embodiment has been described for use as an illuminating device for key locks and doors, the illuminating device may be equally applicable to illumination in other areas such as mailboxes, gate latches, clothes closets or the like where illumination for a short period of time is required. Since the illuminating device 16 is self-timing, energy savings are accomplished. While there has been shown and described a preferred embodiment it is to be understood that various other adaptations and modifications may be made within the spirit and scope of the invention.

I claim:

1. In a device adapted for mounting to a surface for illuminating an adjacent area, the combination comprising:

a base member having means for securing to a surface;

a housing having a closed end and at least one sidewall extending therefrom defining an open end, said closed end being deformable upon depression thereof;

coacting means on said base member and the open end of said sidewall for securing said housing to said base member;

lens means in said at least one sidewall; and electrically operable illumination means within said housing operable upon depression of said closed end.

2. The combination according to claim 1 wherein said illumination means includes switch means within said housing adjacent said closed end for actuation upon depression of said closed end.

3. The combination according to claim 2 wherein said illumination means further includes a battery and a lamp adjacent said lens means and an electronic circuit with time delay means, momentary actuation of said switch means providing conduction from said battery through said lamp means by means of said electronic circuitry for a time duration determined by the time delay means.

4. The combination according to claim 3 wherein said housing is a frusto-conical housing formed of a plastic material, said closed end is a generally dish-shaped plate portion integrally formed therewith.

5. In a device for providing illumination, the combination comprising:

a housing having lens means in a sidewall thereof and a deformable pressure plate portion;

means for receiving a battery within said housing;

lamp means within said housing adjacent said lens means;

switch means within said housing in proximity to said pressure plate portion for actuation upon depression thereof;

electronic timing means providing an output for a predetermined time duration;

first semiconductor switch means operable in response to momentary actuation of said switch means for energizing said timing means;

second semiconductor switch means in series circuit relation with said lamp means and the battery, said second semiconductor switch means being rendered conductive in response to the output of said timing means; and semiconductor holding means responsive to said output for maintaining said first semiconductor switch means conductive for the time duration of said output for energizing said timing means only so long as said output exists.

6. The combination according to claim 5 wherein said holding means are further coupled in circuit relation with said second semi-conductor switch means for maintaining said second semi-conductor switch means conductive for the timed duration of said timing means output.

7. The combination according to claim 6 wherein said first and second semi-conductor switch means are transistor switch means.

8. The combination according to claim 7 wherein said semi-conductor holding means includes diodes.

9. The combination according to claim 8 wherein said electronic timing means includes capacitance means charged in response to conduction of said first semi-conductor switch means.

10. In a device for providing illumination, the combination comprising:

housing means;

lamp means within said housing;

a source of electrical power;

momentary switch means having one terminal thereon connected to said power source;

electronic timing means providing an output for a predetermined time duration;

first semi-conductor switch means operable in response to momentary actuation of said switch means for energizing said timing means;

second semi-conductor switch means in series circuit relation with said lamp means and said power source, said second semi-conductor switch means being rendered conductive in response to the output of said timing means; and semi-conductor holding means responsive to said output for maintaining said first semi-conductor switch means conductive for the time duration of said output for energizing said timing means only so long as said output exists.

* * * * *